United States Patent [19]

Schmitz

[11] Patent Number: 4,917,054

[45] Date of Patent: Apr. 17, 1990

[54] SIX-STROKE INTERNAL COMBUSTION ENGINE

[76] Inventor: Gerhard B. Schmitz, Silivio Gesell-Strasse, 19, B-4780 Saint-Vith, Belgium

[21] Appl. No.: 224,496

[22] Filed: Jul. 26, 1988

[30] Foreign Application Priority Data

Jul. 30, 1987 [BE] Belgium ..... 8700847

[51] Int. Cl.[4] ..... F02B 75/02

[52] U.S. Cl. ..... 123/59 EC; 123/64

[58] Field of Search ..... 123/64, 51 R, 51 A, 123/52 R, 59 A, 59 EC, 311

[56] References Cited

U.S. PATENT DOCUMENTS

| | | | |
|---|---|---|---|
| 1,339,176 | 5/1920 | Dyer | 123/64 |
| 1,367,797 | 2/1921 | Cage | 123/64 |
| 1,539,938 | 6/1925 | Franchimont et al. | 123/64 |
| 1,771,335 | 7/1930 | Karpes | 123/64 |
| 1,882,971 | 10/1932 | Schimanek | 123/64 |
| 4,367,700 | 1/1983 | Pace | 123/64 |
| 4,641,613 | 2/1987 | Delesalle | 123/64 |

FOREIGN PATENT DOCUMENTS

| | | | |
|---|---|---|---|
| 2547625 | 12/1984 | France | 123/64 |

*Primary Examiner*—David A. Okonsky

*Attorney, Agent, or Firm*—Steinberg & Raskin

[57] ABSTRACT

A six-stroke internal combustion engine with reciprocating pistons wherein the six strokes are the admission of air, the first compression accompanied or followed by a possible cooling, a second compression followed by a combustion, the first expansion producing a usable work, the second expansion producing also a usable work and finally the discharge of the combustion gases, this engine, whose combustion is either with spark-ignition (gasoline version) or with auto-ignition (diesel version), will include preferably a multiple of five non-uniform cylinders, and will have an energy efficiency of up to 30% higher than that of a four-stroke internal combustion engine.

14 Claims, 6 Drawing Sheets

Fig. 1 a)
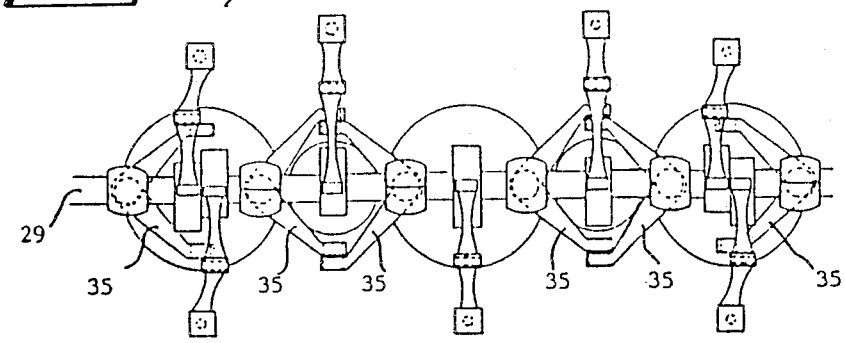
Fig. 1 b)
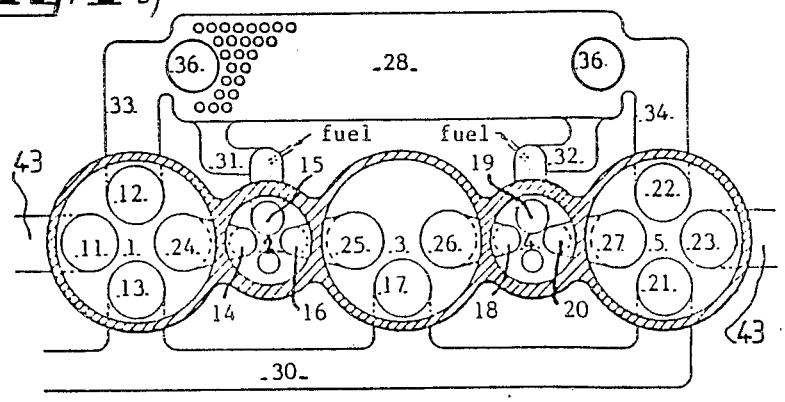
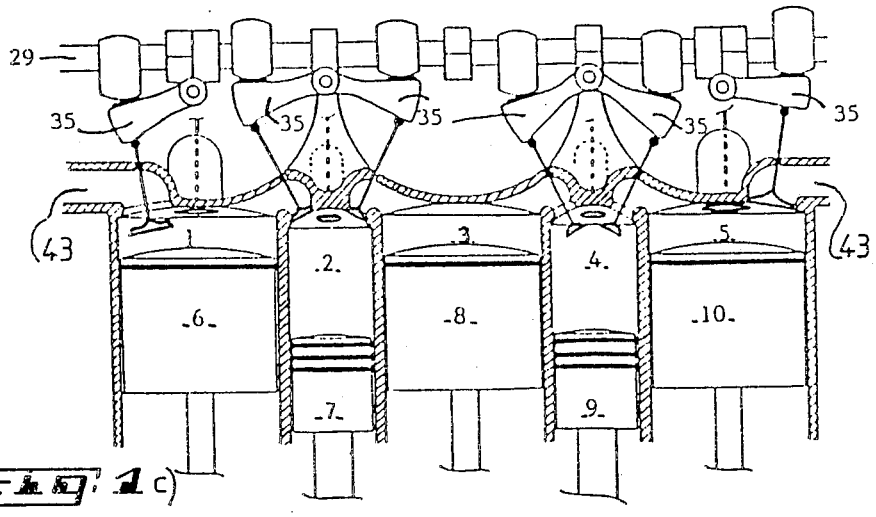
Fig. 1 c)

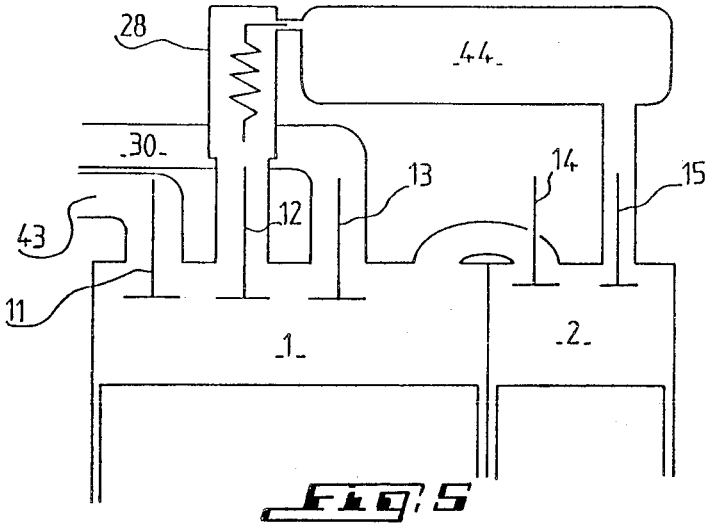
Fig. 5
Fig. 6 a)
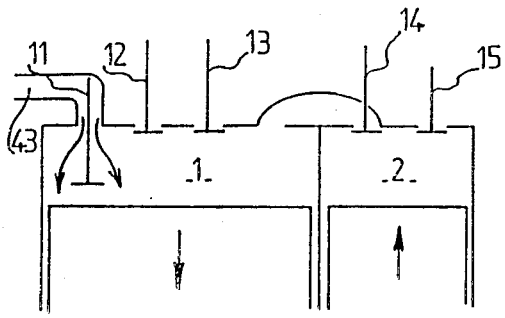
Fig. 6 b)
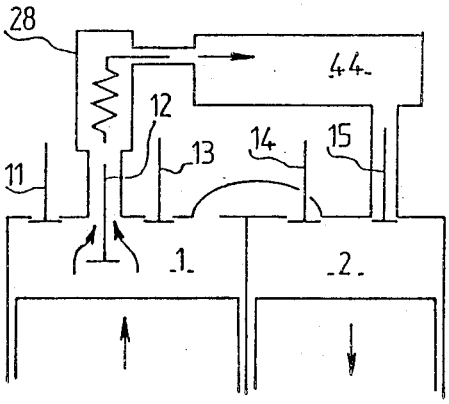
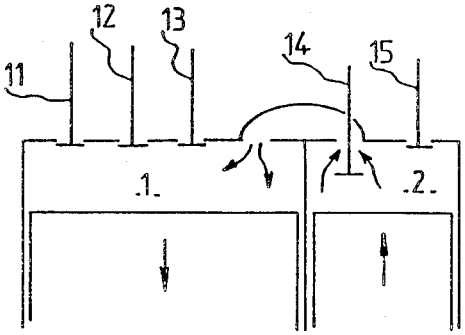
Fig. 6 c)
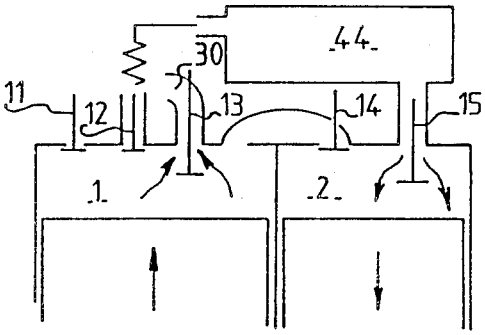
Fig. 6 d)

SIX-STROKE INTERNAL COMBUSTION ENGINE

BACKGROUND OF THE INVENTION

The present invention concerns piston internal combustion engines, such as used for example in road transport vehicles. At present, there exists in particular two types of piston internal combustion engines, which are the spark ignition engine, or gasoline engine, and the auto-ignition engine also called diesel engine.

These engines use either a two-stroke thermodynamic cycle or, as in the great majority of the cases, a four-stroke cycle. The main parts of such an engine are a cylinder containing a piston effecting a reciprocal movement which is converted into a rotative movement by means of a connecting rod and of a crankshaft. The four strokes of a spark ignition engine will now be briefly explained. The piston sucks up an air-fuel mixture by going back and then compresses it by going forth and the fuel evaporates under the increase of temperature. When the piston comes close to its dead point, an ignition plug ignites the mixture by means of a spark which provokes a sudden rise of temperature and of pressure. The backward motion of the piston permits the combustion gases to expand and the usable work is produced at this moment. Finally, the forward movement of the piston expels the combustion gases. Therefore, the four strokes are the admission, the compression, the expansion and the discharge. The diesel engine uses a comparable principle where the difference resides in the way of introducing the fuel, which, in this case, is directly injected into the compressed and therefore hot air, and flames up then spontaneously.

In both cases, the energy efficiency depends, among others, on the compression volume ratio. The higher it is, the higher is the efficiency. Unfortunately, this compression ratio is limited, in the case of the gasoline engine, by the risk of premature knocking of the mixture and in the case of the diesel engine among others by the necessity to keep an appropriate combustion chamber. Anyway, it is to be noted that for a thermodynamic cycle such as disclosed above, the increase in efficiency becomes weaker and weaker for an equal increase of the compression ratio starting from a value of 10 to 15 for the latter, and, in the case of the diesel engine, the mechanical stresses determine mainly the critical volumetric compression ratio. The documents which have been used to reflect the state of the art are the book of professor A. Houberechts at the Catholic University of Louvain called "La thermodynamique technique" (the technical thermodynamics), volume 2, 4th edition, pages 325 to 405, published by Ceuterick at Leuven in 1976 and the lecture notes "Moteurs à combustion interne" (internal combustion engines) of the year 1981 of professor J. Martin at the U.C.L.

SUMMARY OF THE INVENTION

The main object of the present invention is to increase the energy efficiency of the internal combustion engine with reciprocating pistons. At first, in the case of the spark ignition engine where it was realized that the same principle can be applied to the case of the auto-ignition engine too, it was thought of increasing the compression ratio with the aid of a multistage compression where an intensive cooling separates the two or more compression stages in order not to run the risk of a premature knocking of the air-fuel mixture. The internal energy of the combustion gases is very high after the combustion so that a multistage expansion seems necessary in order to transform the greatest possible amount of this energy into mechanical work. In the case of a double compression and of a double expansion, we define the six-stroke thermodynamic cycle as being a cycle comprising an admission of the air or of an air-fuel mixture, a first compression of the latter accompanied or followed by a possible cooling, then a second compression followed by the combustion, then a first expansion of the combustion gases producing a usable mechanical work, then a second expansion of these same combustion gases producing also a usable mechanical work and comprising finally the discharge of the combustion gases.

The invention is an internal combustion engine with reciprocating pistons performing in an efficient manner the six-stroke thermodynamic cycle, such as defined above. The essential novelty of this engine with respect to the conventional internal combustion engine with reciprocating pistons is that the different cylinders are not uniform. Indeed, the cylinders of the new engine will correspond to one of the three following definitions. There will be at least one "low pressure admission cylinder" defined as a cylinder-reciprocating piston assembly, the latter being connected to the crankshaft with the aid of a connecting rod, and whose cylinder head is equipped with at least one admission valve, with at least one valve for discharging the precompressed air or air-fuel mixture, at least one valve for discharging the combustion gases under low pressure and at least one valve or pipe for transferring combustion gases under high pressure, and useful only for the admission of the air or of the air-fuel mixture, for compressing it a first time by discharging it, then for receiving the combustion gases under high pressure, for participating in their second expansion and, finally, for discharging them. In this same engine, there will be at least one "high pressure combustion cylinder" defined as a cylinder-reciprocating piston assembly, the piston being connected to the crankshaft through a connecting rod and whose cylinder head is equipped with at least one valve for admitting precompressed air or air-fuel mixture, at least one valve or pipe for transferring the combustion gases under high pressure, at least one ignition plug or fuel injection nozzle, and useful only for receiving the precompressed air or air-fuel mixture, for compressing it for the second time, for undergoing the combustion, for expanding the combustion gases for the first time and finally for discharging these same gases under high pressure through the transfer pipe or pipes. In this same new engine, there will be possibly a third type of cylinder, which is the "low pressure discharge cylinder" defined as a cylinder-piston assembly, the piston being connected to the crankshaft through a connecting rod, and whose cylinder head is equipped with at least one valve for discharging the combustion gases under low pressure and with at least one valve or pipe for transferring the combustion gases under high pressure, and useful only for receiving the combustion gases under high pressure, for participating in their second expansion and for discharging them.

The first stroke of the six-stroke cycle, i.e. the admission of the air or of the air-fuel mixture, involves only low pressure admission cylinders. The third and fourth strokes of this same cycle, i.e. the second compression and the first expansion of the combustion gases respectively, involve only high pressure combustion cylinders. The final discharge of the combustion gases under low pressure, which represents the sixth stroke of the cycle, involves only low pressure admission cylinders and low pressure discharge cylinders, if any. The second stroke of the said cycle, i.e. the first compression of the air or of the air-fuel mixture accompanied or followed possibly by a cooling, involves a low pressure admission cylinder and a high pressure combustion cylinder preferably in such a way that the piston of the second goes back to be able to receive the precompressed air or air-fuel mixture while the piston of the other goes forward and discharges this same fluid. Consequently, they will move in opposition of phase with respect to each other and such an assembly of a low pressure admission cylinder and of a high pressure combustion cylinder will be called thereafter a "pair of compressing cylinders". The fifth stroke of the six-stroke cycle, i.e. the second expansion of the combustion gases, involves a low pressure admission cylinder, a high pressure combustion cylinder and possibly a low pressure discharge cylinder in such as manner that the piston of the high pressure combustion cylinder discharges by going forward the combustion gases through the transfer pipe or pipes towards the adjacent low pressure admission cylinder whose piston then goes back for receiving these same gases or a portion thereof, and possibly towards the low pressure discharge cylinder, which is also adjacent to this same high pressure combustion cylinder, and whose piston goes back also for receiving the other portion of the combustion gases. This piston and that of the low pressure admission cylinder move mutually in phase and in opposition of phase with respect to the piston of the high pressure combustion cylinder. In the absence of the low pressure discharge cylinder, the assembly of both cylinders effecting the second expansion as disclosed before will be called a "pair of expanding cylinders" and in the case where the low pressure discharge cylinder exists, it will be called a "triplet of expanding cylinders". It is then seen that two cylinders forming a pair of compressing cylinders will preferably not form a pair of expanding cylinders or will preferably not belong to a same triplet of expanding cylinders. It is clear that the piston displacement of the low pressure admission cylinders shall be higher than that of the high pressure combustion cylinders in order that the air or the air-fuel mixture be precompressed at the end of the second stroke.

For reasons of symmetry, all the low pressure admission cylinders, as well as all the high pressure combustion cylinders will preferably have the same cylinder bore and the same stroke, respectively. As for the piston displacement of the low pressure discharge cylinders, if these exist, it is to be optimized according to the piston displacements of the high pressure combustion cylinders and of the low pressure admission cylinders. Probably, for reasons of ease of assembling, those will have the same cylinder bore and stroke as the low pressure admission cylinders.

Therefore, this embodiment of the invention is an internal combustion engine composed essentially of at least one pair of compressing cylinders and of at least one pair, possibly one triplet, of expanding cylinders.

According to another embodiment of the invention, the engine comprises one unique pair of cylinders, the precompressed air discharged by the low pressure admission cylinder being stored in a tank before being transmitted to the combustion cylinder at the appropriate time.

The ignition will be either of the spark ignition type, or of the auto-ignition type, and in the one case there will be a six-stroke internal combustion engine with spark ignition and, in the other case, there will be a six-stroke internal combustion engine with auto-ignition.

The main advantage, which is the object of the present invention, with respect to the existing engines, is a notable increase of the energy efficiency. For exchanger powers and maximal pressures which seem to us absolutely admissible, the calculation promises an increase of this efficiency of about 25 to 30% in the case of spark ignition engines, this being due principally to the increase of the total compression ratio. In the case of auto-ignition engines, the increase of efficiency will probably not be so important. In all cases, the presence of the low pressure discharge cylinder is beneficial to the efficiency since it ensures a total expansion ratio higher than the total compression ratio, which is generally an advantage of the six-stroke cycle with respect to the four-stroke cycle.

The compactness of the combustion chamber, which is in fact the clearance volume of the high pressure combustion cylinder of which it is known that it is of a relatively small piston displacement, contributes, in the case of the gasoline version, to avoid the knock, which permits further increasing the compression ratio or using gasoline with a lower octane number, which is therefore less noxious, and in the case of the diesel version, which permits probably increasing the content during the injection of the fuel.

The compactness of the combustion chamber, i.e. the higher volume/cylinder bore ratio, causes a decrease of the thermal losses during the combustion.

A second lower compression ratio (4 . . . 6) and the distribution of the expansion over a complete turn of the crankshaft reduces notably the unfavorable effect on the internal conversion of a non-instantaneous combustion (combustion duration of about 2 milliseconds) for high rotation speeds.

The concentration of high pressures on small cylinders permits saving sealing rings in the large low pressure cylinders, hence a reduction of the mechanical losses. This concentration permits also reducing the weight of the engine.

Another advantage of the new engine is that the exhaust gases are markedly colder, which will ensure a greater lifetime of the exhaust system and, moreover, in combination with the fact that the clearance volume of the admission cylinders will be as small as possible, one can expect a high filling ratio.

The fact that the cylinders in direct communication with the outside, i.e. the low pressure cylinders, undergo no combustion and the fact that the depressions occurring when the low pressure discharge valves are open will be markedly lower, will probably lead to a more favorable sonority.

The major drawback is that the power-total piston displacement ratio is probably lower than that of the existing engines.

DESCRIPTION OF THE DRAWINGS

The invention is described more in detail with reference to the appended drawings, concerning two embodiments, which are a six-stroke combustion engine with five cylinders and an engine with two cylinders. It is first to be noted that the Figures are only theoretical qualitative drawings. Among these Figures:

FIGS. 1*a* to 1*c* are respectively an elevational view of the engine gearbox unit where there is seen the system for controlling the valves, i;e. the camshaft and the rocker arms, an horizontal cross-sectional view of the engine gearbox unit and, finally, a vertical cross-sectionnal view of the same, FIG. 2, in an enlarged scale, shows the different elements of FIG. 4, where all the valves are disposed along a line for the sake of clarity, FIG. 3 in a large scale, shows in vertical cross-section a pipe connection-valve assembly, where the spring is of the surge tank-type, and FIGS. 4*a*–4*d* in a small scale, show at a to d the four phases which are observed for two turns of rotation of the crankshaft, where all the valves are along the same line as in FIG. 2.

FIG. 5 shows diagrammatically an engine according to the invention with one pair of cylinders only;

FIGS. 6*a*–6*d* show at a to d the four phases of operation of the engine according to FIG. 5 in a manner corresponding to FIG. 4;

DESCRIPTION OF THE PREFERRED EMBODIMENTS

Figure 2:
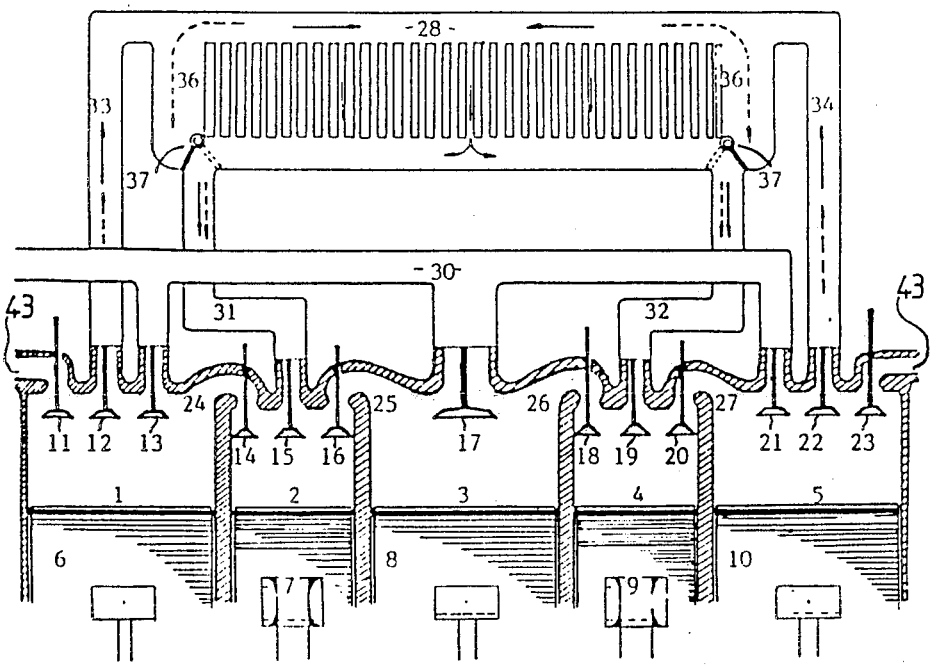
Figure 3:
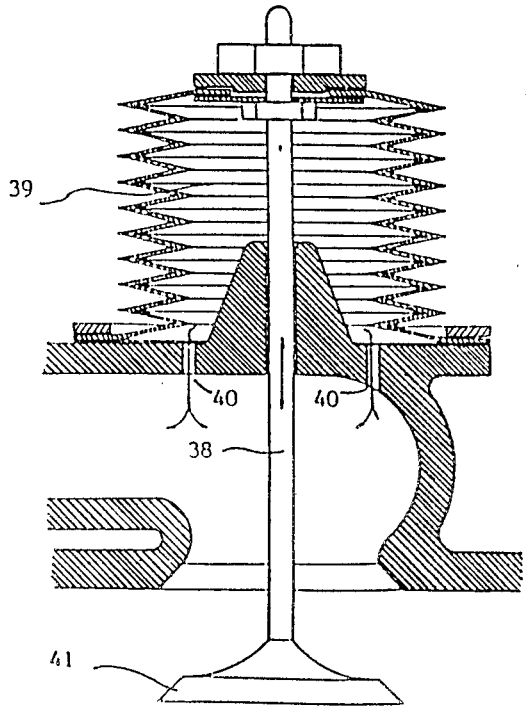

Referring to the Figures, the six-stroke internal combustion engine with spark ignition is obtained with the aid of five cylinders disposed along a line. It comprises two low pressure admission cylinders 1, 5 disposed at the ends of the crankshaft, two high pressure combustion cylinders 2, 4 disposed on the side of the low pressure admission cylinders, respectively, and finally, one low pressure discharge cylinder 3 located in the middle. The inlet of the heat exchanger 28 is connected to the low pressure admission cylinders 1, 5 through the pipes 33, 34 for discharging the precompressed air, respectively, and its output is connected to the high pressure combustion cylinders 2, 4 through the pipes 31, 32 for introducing the precompressed air-fuel mixture, respectively. The introduction of the fuel occurs at these introduction pipes 31 and 32 by means of a controlled injection or of one, preferably of two carburetors under pressure, by submitting for example the trough thereof to the pressure existing inside the exchanger by means of a simple tube connecting both elements. The transfer valves 14, 16, 18 and 20 are located in the cylinder heads of the high pressure combustion cylinders 2 and 4. The low pressure admission and discharge cylinders are connected to the exhaust pipe or manifold 30 through the valves for discharging the combustion gases under low pressures 13, 21 and 17, respectively. The transfer pipes 24, 25 and 26, 27 connect closely cylinders 1 and 2, 2 and 3, 3 and 4 as well as 4 and 5, respectively. The low pressure admission cylinder 1 on the left-hand side and the high pressure combustion cylinder 4 of the right-hand side form a pair of compressing cylinders such as the pair which has been defined above. The second pair of compressing cylinders is formed of the low pressure admission cylinder 5 on the right-hand side and of the high pressure combustion cylinder 2 on the left-hand side. This engine comprises two triplets of expanding cylinders as defined above. These are first the low pressure discharge cylinder 3 located in the middle and the two low pressure admission cylinder 1 and high pressure combustion cylinder 2 on the left-hand side and then the same low pressure discharge cylinder 3 and the low pressure admission cylinder 5 and high pressure combustion cylinder 4 on the right-hand side.

Figure 4:
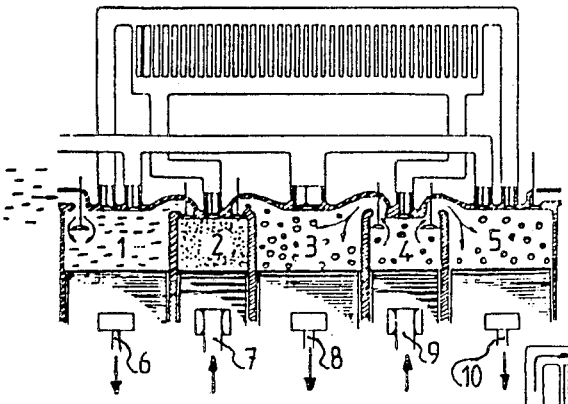
Figure 4:
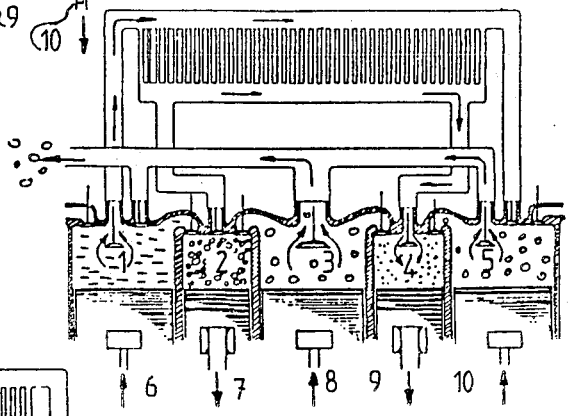
Figure 4:
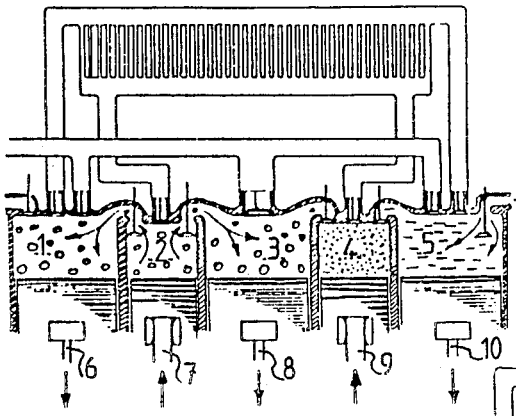
Figure 4:
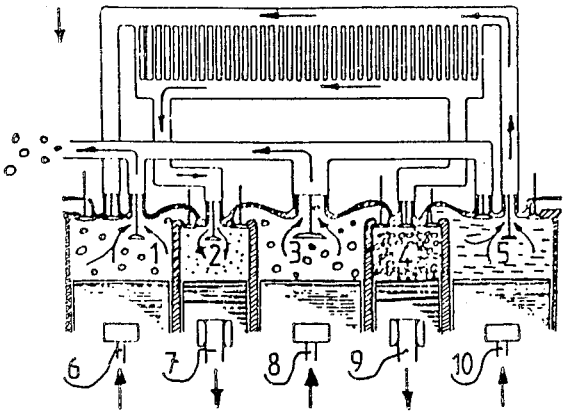

Consider in detail the four phases met during two turns of the crankshaft, for the six-stroke engine with five cylinders described above, with reference to FIGS. 2 and 4.

FIG. 4*a:* the pistons of the high pressure combustion cylinders 7 and 9 are going up, and the pistons of the low pressure cylinders 6, 8 and 10 are going down. The low pressure admission cylinder 1 on the left-hand side effects the intake of the air brought by an intake manifold shown at 43 and the corresponding valve 11 is open. The adjacent high pressure combustion cylinder 2 compresses for the second time the air-fuel mixture and the ignition plug will ignite it at the end of this compression. The second triplet of expanding cylinders 3, 4 and 5 defined above effects the second expansion of the combustion gases, the corresponding transfer valves 18 and 20 being open.

FIG. 4*b:* the pistons of the high pressure combustion cylinders go down and those of the low pressure cylinders go up now. The first pair of compressing cylinders 1, 4 effects the first compression, the corresponding valves 12, 19 being open. The high pressure combustion cylinder 2 effects the first expansion of the combustion gases. The low pressure discharge cylinder 3 and the low pressure admission cylinders 5 on the right-hand side expel the combustion gases, the discharge valves 17 and 21 being open.

FIG. 4*c:* the pistons of the high pressure combustion cylinders go up again while the pistons of the low pressure cylinders go down. The low pressure admission cylinder 5 on the right-hand side effects the air intake in its turn, the admission valve 23 being open. The adjacent high pressure combustion cylinder 4 effects the second compression of the air-fuel mixture and the ignition plug will ignite it at the end of this compression. The first triplet of expanding cylinders 1, 2 and 3 effects the second expansion of the combustion gases, the correspond transfer valves 14, 16 being open.

FIG. 4*d:* the pistons of the high pressure combustion cylinders go down again and those of the low pressure cylinders go up once more. The second pair of compressing cylinders 5 and 2 effects the first compression of the air-fuel mixture, the corresponding discharge and admission valves 22 and 15 being open. The high pressure combustion cylinder 4 on the right hand side effects the first expansion of the combustion gases. The low pressure discharge cylinder 3 and admission cylinder 1 expel the combustion gases. The discharge valves 17 and 13 are open.

Now, we can come back to FIG. 4*a*.

Another embodiment of the six-stroke internal combustion engine would be an engine with five cylinders such as has just been described, where the difference is the way of introducing the fuel, which this time will be direcly injected into the combustion chambers of the high pressure combustion cylinders 2 and 4 where it will then flame up spontaneously. Of course, it will be necessary to adjust again the power of radiator 28 as well as the piston displacement ratio and the compression ratio.

From these two embodiments, another embodiment is deduced by suppressing simply the low pressure discharge cylinder 3, all the other elements remaining unchanged. This version is of course appropriate for both types of ignition. The four cylinders have now no more to be disposed along a line. They can be also disposed on both sides of the crankshaft where the low pressure cylinders are disposed opposite the high pressure combustion cylinder with which they form a pair of compressing cylinders and near the high pressure combustion cylinder with which they form a pair of expanding cylinders. It is clear that other embodiments of the present invention can be obtained by juxtaposing blocks of five or four cylinders as described above.

For all the contemplated embodiments, the heat exchanger 28 can be replaced by two independent radiators in such a manner that each of them connects the pipe 33 (or 34) for discharging the precompressed air of the low pressure admission cylinder 1 (or 5) to the introduction pipe 32 (or 31) of the corresponding high pressure combustion cylinder 4 (or 2). However, in this case, the use of the thermal exchange surfaces will not be so satisfactory, since the speed of the air flow through the exchanger is notable during 25% of the time only, whereas, in the case of the unique exchanger, it is notable during 50% of the time. Nevertheless, this can become interesting for reasons of ease of construction in the case of the six-stroke engine in the diesel version, since the power of the exchanger (the experience will possibly show that the exchanger is not needed) will be probably lower.

Another detail is interesting to consider. The valves 12, 15, 19 and 22 for discharging and admitting precompressed air must ensure a tightness in both directions. Indeed, in operation, the heat exchanger will be steadily under pressure and these valves undergo momentarily a force which tends to open them when the downstream pressure (i.e. the pressure existing inside the exchanger) exceeds the upstream pressure. This will be the case during the admission for the low pressure admission cylinders and at the end of the discharge of the compressed gases for the high pressure combustion cylinders. On the other hand, it must be avoided that the air escapes along the valve stem 38. To remedy these two difficulties, one can think of using surge tank-type springs 39 in the place of conventional valve springs. By boring communication holes 40 for bringing the tank at the pressure existing in radiator 28 and by making sure that the diameter of the tank is larger than that of the foot of valve 41, the pressure existing inside the exchanger as well as the pressure existing inside the cylinder will both tend to close the said valve. When the engine is started, the radiator being not under pressure, the mechanical stiffness of tank 39 only should ensure the closing of the said valve. It is possible to use this same type of spring for the other valves, in particular for the transfer valves 14, 16, 18 or 20. For the low pressure admission or discharge valves 11, 13, 17, 21 and 23, use will be made preferably of conventional valve springs.

Another detail to be noted is that the transfer valves 14 16, 18 and 20 and the admission valves 11 and 23 are centered with respect to the vertical plane of symmetry of the engine gearbox unit. Consequently, the corresponding rocker arms 35 will have a special shape in order that their swivel pins be preferably orthogonal to the axis of the crankshaft.

A last constructive detail concerns the starting from cold, which will probably give rise to problems for the six-stroke engine. A system with tubes 36 and flaps 37, shown diagrammatically in FIG. 2, operated by the user or in an automatic manner, will permit diverting the flow of compressed air in such a manner that it arrives at the high pressure combustion cylinders without passing through the heat exchanger. Referring to FIG. 2, the arrows in continuous line indicate the flow of precompressed air in operation and those in broken line indicate the flow of precompressed air during the starting. The corresponding positions of the flaps are also shown in continuous line and broken line, respectively.

FIG. 5 shows an embodiment of an engine according to the invention which needs only one pair of cylinders, i.e. one low pressure admission cylinder 1 and one combustion cylinder 2. The two-cylinder engine comprises one tank 44 under pressure (5 to 6 bars) which receives the precompressed air coming from the low pressure admission cylinder 1 and which stores it until the high pressure combustion cylinder can receive it.

The two-stroke expansion is effected in the same manner as for the engine with four or five cylinders which has been described above. The second expansion occurs when valve 14 is open, when piston 7 goes up and when piston 6 goes down. The sole difference concerning the operation of the six-stroke engine in the two- and four cylinder versions concerns the first compression. Instead of discharging the precompressed air during the first compression towards the high pressure combustion cylinder 4 of the second pair, the low pressure cylinder in the two cylinder version discharges the precompressed air into tank 44, as shown in FIG. 6 which illustrates the four operation phases of a two cylinder engine working in the six-stroke mode. It is to be noted that the fuel can be added to the precompressed air while the piston 7 is sucking up as it goes down, just before the introduction into the combustion chamber (FIG. 6*d*).

Figure 7:
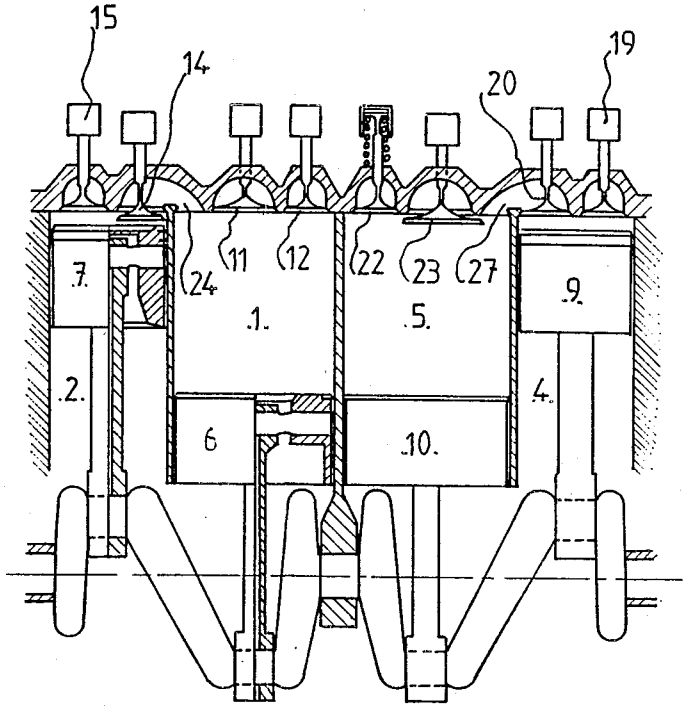
FIGS. 7*a*–7*c* show diagrammatically an engine according to the invention with six strokes and four cylinders, a being a vertical cross-sectional view, b showing the arrangement of the valves and pipes and c showing the arrangement of the cams and lifters.
Figure 7:
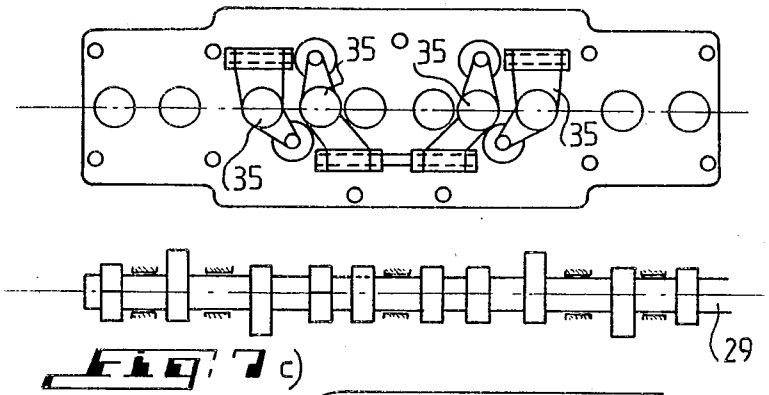
Figure 7:
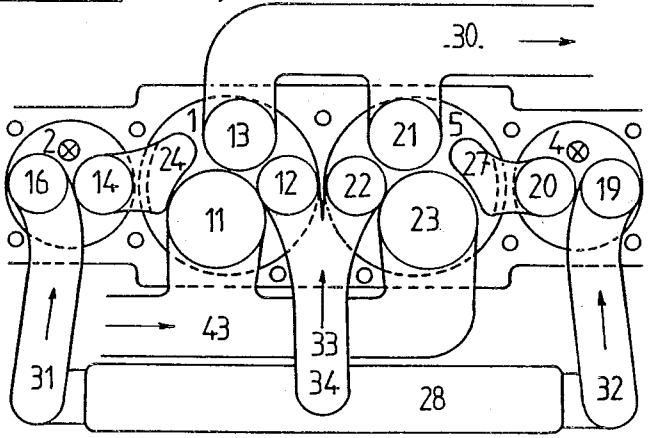

FIG. 7 illustrates diagrammatically with the aid of several views a six-stroke internal combustion engine with four cylinders according to the present invention. FIGS. 7*b* and 7*c* show diagrammatically respectively the arrangement of the valves and of the pipes and the arrangement of the cams and pushers.

Figure 8:
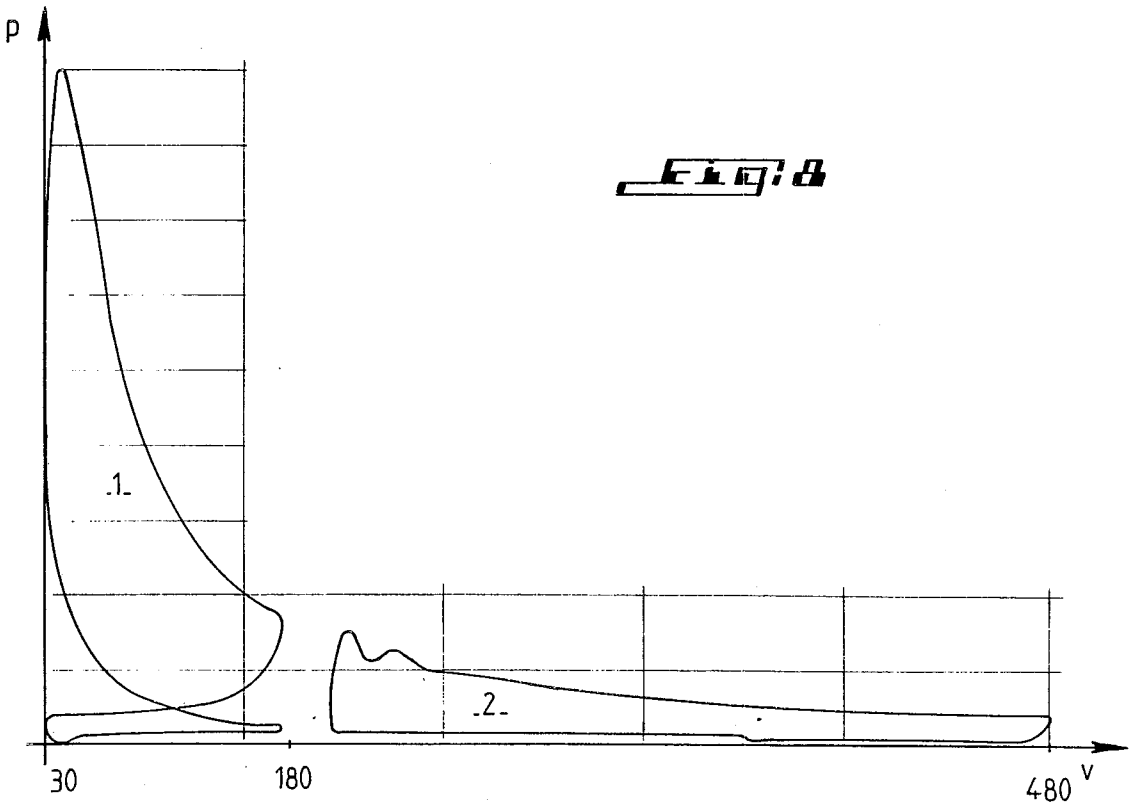
FIG. 8 shows the pressure-volume diagram inside the cylinders of the six-stroke cycle.

FIG. 8 illustrates the six-stroke cycle according to the invention. This Figure shows the diagram of the pressure as a function of the volume inside the cylinders. Curve 1 indicates the pressure existing inside the high pressure combustion cylinder, whereas curve b indicates the pressure obtained in the low pressure admission cylinder. This diagram has been plotted for an engine corresponding to the engine shown in FIG. 7.

The six-stroke internal combustion engine object of the present invention will find use wherever use is made at present of four-stroke internal combustion engines, in particular in the road transport.

The new engine according to the invention, whose combustion is either with spark ignition (gasoline version), or with auto-ignition (diesel version), will preferably include a multiple of five non-uniform cylinders. It will have an energy efficiency which may be up to 30% higher than that of a four-stroke internal combustion engine.

What is claimed is:

1. An internal combustion engine comprising at least one cylinder which includes one working chamber having a volume which is rendered variable by displacement inside the cylinder of a piston between a high dead point position and a low dead point position, under effect of pressure forces periodically produced inside said chamber; and valve means for admission and discharge of a gaseous fluid associated with said at least one cylinder, the piston and cylinder being connected to a crankshaft of the engine;

wherein the engine comprises at least four cylinders disposed to form two pairs, one cylinder of each pair being a high pressure combustion cylinder and the other cylinder being adapted to work as a low pressure admission cylinder, the working chamber of each low pressure admission cylinder being adapted to communicate:

(a) with an air intake manifold through at least one admission valve, for producing a precompression of admitted air;

(b) with the working chamber of the combustion cylinder of the other pair via communication passageway means for discharging into this combustion cylinder the precompressed air, through at least one discharge valve associated with the admission cylinder and through at least one admission valve associated with the combustion cylinder for producing a compression and combustion at a high pressure of the air to which fuel has been added and a first expansion of combustion gases in said combustion cylinder;

(c) with the working chamber of the associated combustion cylinder through at least one transfer valve for transferring the high pressure combustion gases produced in said associated combustion cylinder into the admission cylinder, to produce a second expansion; and (d) with a discharge manifold for the combustion gases which have undergone said second expansion, through at least one discharge valve, said valves being controlled such that the engine operates as a six-stroke internal combustion engine.

2. An engine according to claim 1, comprising a third low pressure cylinder whose working chamber is adapted to communicate respectively with the working chambers of both combustion cylinders through at least one transfer valve associated with each combustion cylinder and working in a synchronous manner with said transfer valve between said combustion cylinder and its associated admission cylinder in order to contribute to said second expansion of the combustion gases, and with the discharge manifold through said at least one discharge valve.

3. An engine according to claim 2, wherein the five cylinders are disposed along a line, the two admission cylinders being located at the ends of the crankshaft to which they are connected, the third low pressure cylinder being located in the middle.

4. An engine according to claim 1, wherein said communication passageway means comprise a heat exchanger whose inlets are adapted to communicate with the working chambers of the admission cylinders through the discharge valves and whose outlets are adapted to communicate with the working chambers of the combustion cylinders through the admission valves.

5. An engine according to claim 1, wherein the communication passageway means between the working chambers of the admission cylinders and the combustion cylinders comprise means for admitting the fuel into the precompressed air flowing therethrough.

6. An engine according to claim 1, comprising a multiple of four cylinders.

7. An engine according to claim 1, comprising a multiple of five cylinders.

8. An engine according to claim 1, wherein at least one valve spring is of a pressurized surge tank-type.

9. An engine according to claim 8, wherein the surge take acting as the valve spring is provided with holes in a pipe wall permitting formation inside the tank of pressure existing downstream of the valve.

10. An engine according to claim 1, wherein the pistons of the low pressure cylinders are arranged to move in phase and in opposition of phase with respect to the pistons of the high pressure combustion cylinders.

11. An engine according to claim 1, wherein the combustion chambers of the high pressure combustion cylinders comprise means for injecting the fuel directly into the admitted precompressed air towards the end of a second compression for an auto-ignition of the such-obtained air-fuel mixture.

12. The engine of claim 5, wherein said admitting means are carburetor means.

13. An internal combustion engine comprising at least one cylinder which includes a working chamber having a volume which is rendered variable by displacement inside the cylinder of a piston between a high dead point position and a low dead point position, under effect of pressure forces periodically produced inside said chamber; and valve means for admission and discharge of a gaseous fluid associated with said at least one cylinder, the piston being connected to a crankshaft of the engine;

said engine comprising at least two cylinders disposed so as to form a pair, one cylinder being a high pressure combustion cylinder, and the other cylinder arranged to work as a low pressure admission cylinder, the working chamber of the low pressure admission cylinder being adapted to communicate with (a) an air intake manifold through at least one admission valve, for producing a precompression of admitted air; and (b) with a tank for discharging to said tank the precompressed air through at least one discharge valve associated with the admission cylinder;

the working chamber of the combustion cylinder being adapted to communicate;

(a) with said tank through at least one admission valve for the precompressed air to which fuel has been added, for compression and combustion of the admitted air to which the fuel has been added at a high pressure and a first expansion of combustion gases; and (b) with the working chamber of the low pressure cylinder through at least one transfer valve for transferring the high pressure combustion gases from the combustion cylinder into the admission cylinder to produce a second expansion;

the low pressure cylinder being adapted to communicate with a discharge manifold for the combustion gases which have been subjected to said second expansion, through at least one discharge valve;

said valves being controlled in such a manner that the engine operates as a six-stroke internal combustion engine.

14. An engine according to claim 13 wherein the aforesaid valves associated with the different cylinders are maintained in an open or closed working state substantially for the whole duration of the stroke of the piston of the corresponding cylinder.

* * * * *